US008753026B2

(12) United States Patent
Haan et al.

(10) Patent No.: US 8,753,026 B2
(45) Date of Patent: Jun. 17, 2014

(54) USE OF A SENSE MARK TO CONTROL A PRINTING SYSTEM

(75) Inventors: Henderikus A. Haan, North Tonawanda, NY (US); Anthony V. Moscato, North Tonawanda, NY (US); Brett Rimes, Grand Island, NY (US); Frank J. Rocco, North Tonawanda, NY (US); Carl F. Armstrong, Amherst, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 1161 days.

(21) Appl. No.: 12/215,521

(22) Filed: Jun. 27, 2008

(65) Prior Publication Data

US 2009/0016785 A1 Jan. 15, 2009

Related U.S. Application Data

(60) Provisional application No. 60/937,660, filed on Jun. 29, 2007.

(51) Int. Cl.

| | |
|---|---|
| ***B41J 11/46*** | (2006.01) |
| ***B41J 29/38*** | (2006.01) |
| *B41J 2/01* | (2006.01) |
| *B41J 15/00* | (2006.01) |

(52) U.S. Cl.

USPC ..... 400/76; 400/583; 347/14; 347/104

(58) Field of Classification Search

USPC ..... 400/583; 399/384, 385, 301

See application file for complete search history.

(56) References Cited

U.S. PATENT DOCUMENTS

| | | | |
|---|---|---|---|
| 3,599,229 | A | 8/1971 | Merrell |
| 3,717,722 | A | 2/1973 | Messner |
| 3,803,628 | A | 4/1974 | Van Brimer et al. |
| 3,911,818 | A | 10/1975 | MacIlvaine |
| 3,925,790 | A | 12/1975 | Fischbeck |
| 4,146,900 | A | 3/1979 | Arnold |
| 4,219,822 | A | 8/1980 | Paranjpe |
| 4,238,804 | A | 12/1980 | Warren |
| 4,320,406 | A | 3/1982 | Heinzl |

(Continued)

FOREIGN PATENT DOCUMENTS

| | | |
|---|---|---|
| EP | 317 762 | 5/1989 |
| EP | 319 223 | 6/1989 |

(Continued)

OTHER PUBLICATIONS

International Search Report and Written Opinion in International Application No. PCT/US07/03240 dated Sep. 27, 2007.

(Continued)

*Primary Examiner* — Daniel J Colilla
(74) *Attorney, Agent, or Firm* — McCracken & Frank LLC

(57) ABSTRACT

A method of printing on a substrate includes the steps of instructing a first imaging unit to print a first image and a registration mark on a substrate contemporaneously during a production run and detecting the registration mark. The method further includes the steps of determining a position on the substrate where a second image is to be printed in accordance with the detection of the registration mark and instructing a second imaging unit to print the second image on the substrate in accordance with the determined position.

8 Claims, 7 Drawing Sheets

(56) References Cited

U.S. PATENT DOCUMENTS

| | | | | |
|---|---|---|---|---|
| 4,401,024 | A | 8/1983 | Frentress | |
| 4,463,359 | A | 7/1984 | Ayata et al. | |
| 4,477,103 | A | 10/1984 | Bertolazzi | |
| 4,728,968 | A | 3/1988 | Hillmann et al. | |
| 4,736,213 | A | 4/1988 | Piatt et al. | |
| 4,789,147 | A | 12/1988 | Berger et al. | |
| 4,792,860 | A | 12/1988 | Kuehrle | |
| 4,804,979 | A | 2/1989 | Kamas et al. | |
| 4,835,713 | A | 5/1989 | Pastor | |
| 4,839,674 | A | 6/1989 | Hanagata et al. | |
| 4,847,660 | A | 7/1989 | Wheatley, Jr. et al. | |
| 4,878,063 | A | 10/1989 | Katerberg | |
| 4,994,975 | A | 2/1991 | Minschart | |
| 5,031,530 | A | 7/1991 | Burger | |
| 5,069,124 | A | 12/1991 | Schneider | |
| 5,079,571 | A | 1/1992 | Eriksen | |
| 5,087,805 | A | 2/1992 | Silverschotz et al. | |
| 5,102,110 | A | 4/1992 | Reynolds | |
| 5,129,568 | A | 7/1992 | Fokos et al. | |
| 5,137,304 | A | 8/1992 | Silverschotz et al. | |
| 5,160,946 | A | 11/1992 | Hwang | |
| 5,224,640 | A | 7/1993 | Fokos et al. | |
| 5,266,976 | A | 11/1993 | Ohigashi et al. | |
| 5,287,162 | A | 2/1994 | de Jong et al. | |
| 5,289,208 | A | 2/1994 | Haselby | |
| 5,298,761 | A | 3/1994 | Aoki et al. | |
| 5,313,886 | A | 5/1994 | Mueller | |
| 5,365,847 | A | 11/1994 | Pers | |
| 5,384,592 | A | 1/1995 | Wong | |
| 5,408,746 | A | 4/1995 | Thoman et al. | |
| 5,434,956 | A | 7/1995 | Son et al. | |
| 5,526,107 | A * | 6/1996 | Bronstein | 399/299 |
| 5,548,390 | A * | 8/1996 | Sugisaki et al. | 399/364 |
| 5,568,168 | A | 10/1996 | Watanabe | |
| 5,617,128 | A | 4/1997 | Thoman et al. | |
| 5,648,801 | A | 7/1997 | Beardsley et al. | |
| 5,688,059 | A | 11/1997 | Clarke et al. | |
| 5,689,289 | A | 11/1997 | Watanabe et al. | |
| 5,704,282 | A | 1/1998 | Khalid | |
| 5,715,498 | A | 2/1998 | Takeuchi et al. | |
| 5,765,083 | A | 6/1998 | Shinohara | |
| 5,765,481 | A | 6/1998 | Tortora et al. | |
| 5,784,077 | A | 7/1998 | Silverbrook | |
| 5,793,397 | A | 8/1998 | Barker et al. | |
| 5,796,411 | A | 8/1998 | Cyman et al. | |
| 5,796,414 | A | 8/1998 | Sievert et al. | |
| 5,797,305 | A | 8/1998 | Harrod et al. | |
| 5,806,430 | A | 9/1998 | Rodi | |
| 5,868,069 | A | 2/1999 | Khalid et al. | |
| 5,889,534 | A | 3/1999 | Johnson et al. | |
| 5,937,756 | A | 8/1999 | Kishine et al. | |
| 5,949,438 | A | 9/1999 | Cyman et al. | |
| 5,995,717 | A | 11/1999 | Tanaka | |
| 6,003,988 | A | 12/1999 | McCann et al. | |
| 6,065,400 | A | 5/2000 | Van Weverberg | |
| 6,068,362 | A | 5/2000 | Dunand et al. | |
| 6,072,587 | A | 6/2000 | Hicks | |
| 6,109,722 | A | 8/2000 | Underwood et al. | |
| 6,120,142 | A | 9/2000 | Eltgen et al. | |
| 6,126,267 | A | 10/2000 | Ito et al. | |
| 6,146,035 | A | 11/2000 | Ishigouoka et al. | |
| 6,213,580 | B1 | 4/2001 | Segerstrom et al. | |
| 6,224,192 | B1 | 5/2001 | Robinson et al. | |
| 6,236,463 | B1 | 5/2001 | Cyman et al. | |
| 6,317,147 | B1 | 11/2001 | Tanaka | |
| 6,325,480 | B1 | 12/2001 | Moghadam et al. | |
| 6,334,666 | B1 | 1/2002 | Inui et al. | |
| 6,335,748 | B1 * | 1/2002 | Furst | 347/116 |
| 6,375,296 | B1 | 4/2002 | McGarry et al. | |
| 6,381,440 | B1 * | 4/2002 | Bock et al. | 399/384 |
| 6,390,588 | B1 | 5/2002 | Ikeda | |
| 6,409,301 | B1 | 6/2002 | Takata et al. | |
| 6,411,324 | B1 | 6/2002 | Christiansen et al. | |
| 6,422,678 | B1 | 7/2002 | Serra et al. | |
| 6,446,100 | B1 | 9/2002 | Warmus et al. | |
| 6,450,607 | B1 | 9/2002 | Bolash et al. | |
| 6,450,614 | B1 | 9/2002 | Scheffelin et al. | |
| 6,460,441 | B1 | 10/2002 | Harrod | |
| 6,467,768 | B1 | 10/2002 | Vary et al. | |
| 6,467,874 | B1 | 10/2002 | Williams et al. | |
| 6,474,886 | B1 | 11/2002 | Sugiyama et al. | |
| 6,499,822 | B1 | 12/2002 | Abe et al. | |
| 6,501,929 | B1 * | 12/2002 | Warbus et al. | 399/130 |
| 6,547,370 | B2 | 4/2003 | Mantell et al. | |
| 6,599,040 | B2 | 7/2003 | Nakazawa et al. | |
| 6,622,621 | B2 | 9/2003 | Bucher et al. | |
| 6,637,860 | B1 | 10/2003 | Madeley | |
| 6,644,773 | B2 | 11/2003 | Bildstein et al. | |
| 6,663,206 | B2 | 12/2003 | Taylor | |
| 6,682,163 | B2 | 1/2004 | Metzler et al. | |
| 6,688,721 | B1 | 2/2004 | Serra | |
| 6,712,444 | B2 | 3/2004 | Abe et al. | |
| 6,763,220 | B2 | 7/2004 | Nakazawa | |
| 6,789,870 | B2 | 9/2004 | Barnes et al. | |
| 6,891,630 | B1 | 5/2005 | Miyasaka et al. | |
| 6,909,516 | B1 | 6/2005 | Hoover | |
| 7,013,803 | B2 | 3/2006 | Hansen et al. | |
| 7,014,289 | B1 | 3/2006 | Matsuda | |
| 7,021,732 | B2 | 4/2006 | Folkins | |
| 7,021,738 | B2 | 4/2006 | Juan et al. | |
| 7,061,630 | B2 | 6/2006 | Murray | |
| 7,103,306 | B2 * | 9/2006 | Shimizubata | 399/306 |
| 7,108,369 | B2 | 9/2006 | Newsome et al. | |
| 7,168,784 | B2 | 1/2007 | Donovan et al. | |
| 7,209,600 | B2 | 4/2007 | Goldberg | |
| 7,216,952 | B2 | 5/2007 | Claramunt et al. | |
| 7,242,494 | B2 | 7/2007 | Hanazato | |
| 7,251,437 | B2 | 7/2007 | Tamoto et al. | |
| 7,265,769 | B2 * | 9/2007 | Amarakoon | 347/118 |
| 7,309,118 | B2 | 12/2007 | Mizes et al. | |
| 7,390,133 | B2 * | 6/2008 | Hatayama | 400/149 |
| 7,543,911 | B2 | 6/2009 | Mizes et al. | |
| 7,552,986 | B2 | 6/2009 | Mizes et al. | |
| 7,967,407 | B2 * | 6/2011 | Moscato et al. | 347/14 |
| 2002/0167554 | A1 | 11/2002 | Parry | |
| 2003/0030686 | A1 * | 2/2003 | Abe et al. | 347/16 |
| 2003/0165349 | A1 * | 9/2003 | Nakazawa | 399/384 |
| 2005/0073539 | A1 | 4/2005 | McGarry et al. | |
| 2005/0286915 | A1 | 12/2005 | Butikofer | |
| 2006/0039015 | A1 | 2/2006 | Kageyama et al. | |
| 2006/0139392 | A1 | 6/2006 | Fernandez et al. | |
| 2008/0112746 | A1 * | 5/2008 | Yamamoto | 399/385 |
| 2008/0278735 | A1 * | 11/2008 | Wang et al. | 358/1.5 |

FOREIGN PATENT DOCUMENTS

| | | | | |
|---|---|---|---|---|
| EP | 729846 | A2 * | 9/1996 | B41J 25/34 |
| EP | 835 761 | | 4/1998 | |
| EP | 1 522 411 | | 4/2005 | |
| FR | 2 605 268 | | 4/1988 | |
| JP | 01142671 | A * | 6/1989 | G03G 15/01 |
| JP | 05016341 | A * | 1/1993 | B41J 2/01 |
| JP | 8-143182 | | 6/1996 | |
| JP | 08216467 | A * | 8/1996 | B41J 13/00 |
| JP | 08290560 | A * | 11/1996 | B41J 2/01 |
| JP | 11320923 | A * | 11/1999 | B41J 2/21 |
| JP | 2003175591 | A * | 6/2003 | B41J 2/01 |
| JP | 2004-112045 | | 4/2004 | |
| JP | 2006205358 | A * | 8/2006 | B41J 29/46 |
| WO | 2007092490 | | 8/2007 | |

OTHER PUBLICATIONS

International Preliminary Report on Patentability for Application No. PCT/US07/03240 dated Aug. 14, 2008.

European search opinion and supplementary European search report dated Jan. 15, 2009 for EP1979117.

Int'l Preliminary Report on Patentability for Application No. PCT/US2008/008115 dated Jan. 14, 2010.

Reply to Written Opinion accompanying the European Search Report, dated Jul. 27, 2009, for Application No. EP1979117.

Search Report in EP 07 76 3655 dated Jan. 5, 2009.

International Search Report and Written Opinion in PCT/US2008/008115 dated Jan. 20, 2009.

(56) References Cited

OTHER PUBLICATIONS

International Preliminary Report on Patentability for Application No. PCT/US2008/008115 dated Jan. 4, 2010.
Preliminary Amendment in EP Application No. 07763655.3 dated Mar. 28, 2008 (11 pages).
Supplemental European Search Report in EP Application No. 07763655.3 dated Feb. 3, 2009 (10 pages).
Response to Official Letter in EP Application No. 07763655.3 dated Jul. 27, 2009 (16 pages).
Notice of Patent Grant in EP Application No. 07763655.3 dated Nov. 18, 2009 (25 pages).

* cited by examiner

USE OF A SENSE MARK TO CONTROL A PRINTING SYSTEM

CROSS-REFERENCE TO RELATED APPLICATIONS

This application claims the benefit of U.S. Provisional Application Ser. No. 60/937,660, filed Jun. 29, 2007, and incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to printing systems and more particularly to high-speed printing systems that use a sense mark on a substrate to control the printing of images or data on the substrate.

2. Description of the Background of the Invention

High-speed printing systems typically print on a paper web by moving the paper web along a paper path using rollers or drums past printheads. A controller controls the printheads to print images on the paper web as the paper web moves under and/or over the printheads. In printing systems that include multiple imaging units, each imaging unit may include a plurality of printheads and each imaging unit may print a different color on the paper web. A first imaging unit prints a first color used for an image and a subsequent imaging unit prints a second color overlaid on the same image and so on with additional imaging units and colors. In order to align the printed images, it is important to track the position of the printed images with respect to the printheads included in each imaging unit.

In high-speed printing systems, the speed at which the paper web is moving along the paper path can be on the order of hundreds of feet/meters per second. In addition, the paper web dimensions may change due to moisture and other forces exerted on the paper web. These and other factors make it difficult to accurately track the position of the paper web and provide accurate control of the printheads.

Prior print systems and methods have included the printing of a sense mark on the substrate that indicates a top of the page. A sensor detects the sense mark and a controller tracks the position of the sense mark with respect to the printheads on each imaging unit. The controller instructs the printheads to print on the paper web in accordance with the detection of the sense mark. Prior print systems use a first printhead on a first imaging unit to print the sense mark on the paper web. Consequently, the sense mark is located along a side margin of the paper web, where subsequent images are not printed. This arrangement requires a larger paper web width to produce a printed image of a particular size because of the unused margin where the sense mark is printed. Further, these prior systems have not adequately addressed the issue of accurately detecting the sense mark and tracking the paper web.

Other prior art systems and methods track a lateral registration mark or a side edge of a substrate such as a paper web to detect problems such as shrinkage, expansion, drift, and/or skew of the paper web in a multi-color printing process. Such prior systems and methods use complex registration marks and algorithms to correct for such problems as shrinkage and expansion and do not adequately prevent or minimize such problems before they occur.

SUMMARY OF THE INVENTION

In one embodiment, a method of printing on a substrate includes the steps of instructing a first imaging unit to print a first image and a single registration mark associated with the first image on a substrate contemporaneously during a production run and detecting the registration mark. The method further includes the steps of calculating an offset along a width direction of the substrate based on the detected single registration mark and determining a position on the substrate where a second image is to be printed in accordance with the calculated offset, wherein the second image is shifted in its entirety and printed on the same side of the substrate as the first image and instructing a second imaging unit to print the second image on the substrate in accordance with the determined position.

Other aspects and advantages of the present invention will become apparent upon consideration of the following detailed description.

DETAILED DESCRIPTION OF THE PREFERRED EMBODIMENTS

Figure 1:
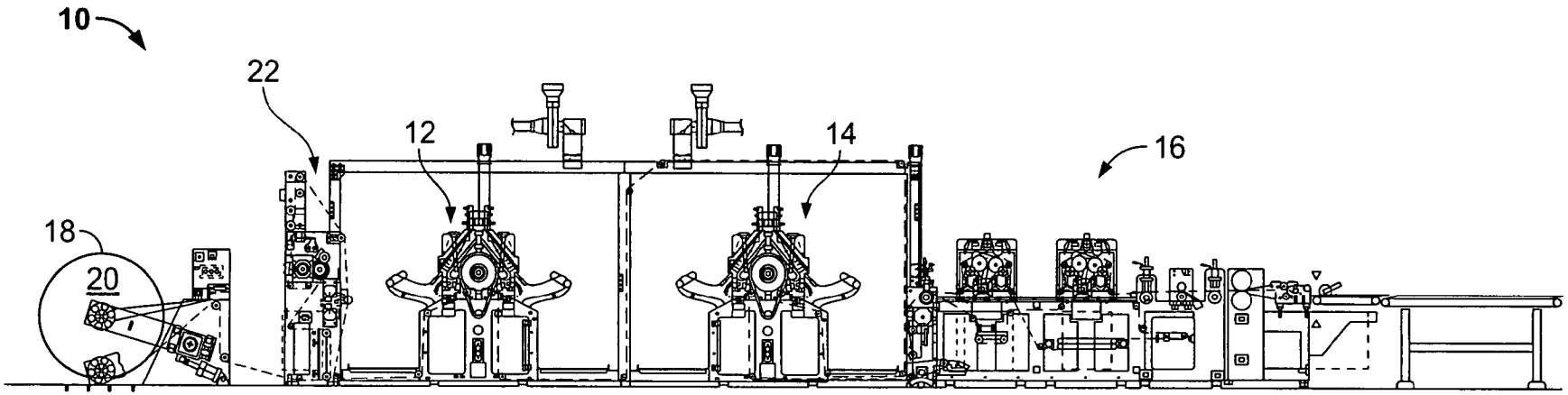
FIG. 1 is a side elevational view of a printing system according to an embodiment.

FIG. 1 shows an embodiment of a printing system 10 configured with two imaging units 12, 14 and finishing systems 16 downstream of the imaging units. A paper web 18 arranged in a roll 20 is fed through the imaging units 12, 14 and finishing systems 16. A sense mark printer 22 upstream from the imaging units 12, 14 prints a sense mark on the paper web 18. The first imaging unit 12 prints on a first or front side of the paper web 18 and the second imaging unit 14 prints on a second or back side of the paper web. A plurality of cylinders and turn-bars (shown in more detail in FIGS. 3, 5, and 6) controls the paper path through the printing system 10 so that the paper web 18 need not be turned to permit duplex printing. If desired, only a single imaging unit is provided to enable simplex printing. In another embodiment, a single imaging unit is used for duplex printing by feeding the paper web through the imaging unit a first time to print on a first side of the paper web, turning the paper web, and feeding the paper web through the imaging unit a second time to print on the second side. Additional imaging units may be included to print in additional colors.

Figure 2B:
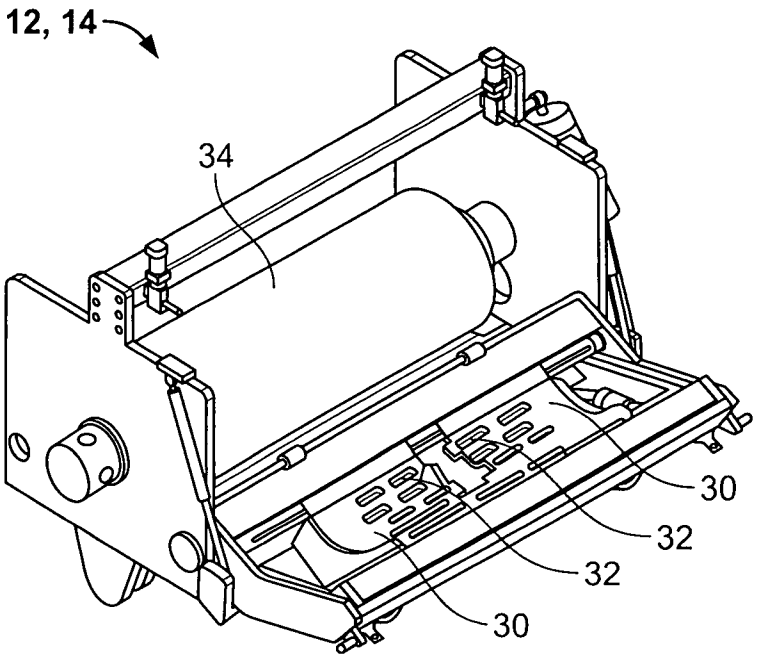
FIG. 2B is a front isometric view of the imaging unit of FIG. 2A in a second state.
Figure 2A:
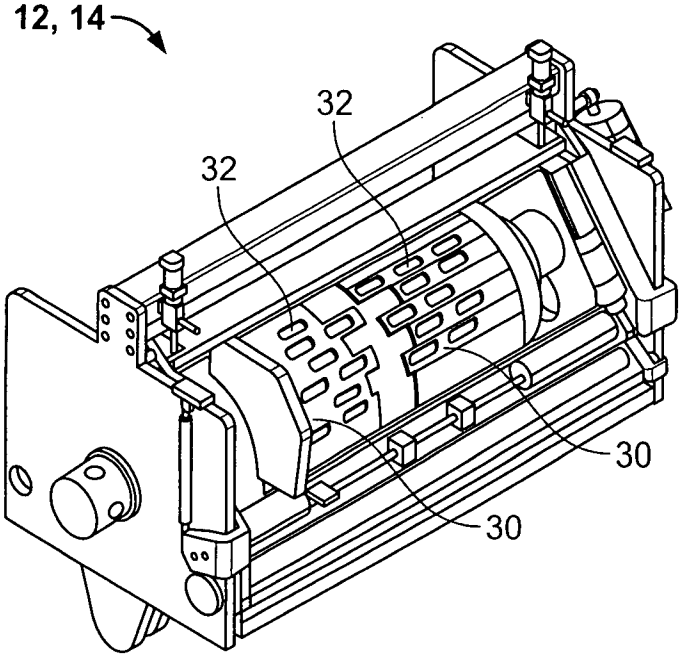
FIG. 2A is a front isometric view of an imaging unit used in the printing system of FIG. 1 in a first state.

FIGS. 2A and 2B show one side of the imaging units 12, 14 including two printhead assemblies 30, wherein each printhead assembly includes one or more slots 32 for receiving inkjet printheads or cartridges (not shown). Examples of suitable printheads are those used in desktop printers or plotters. The printhead assemblies 30 can be positioned around a drum 34 that rotates and drives a paper web past the printhead assemblies. A controller (not shown) stores the position of one or more printheads in the slots 32 with respect to the drum. As the drum 34 rotates and the paper web 18 passes under the printheads, the controller instructs the printheads to print images on the paper web. The controller divides a raster line among the plurality of printheads in accordance with the position of the paper web with respect to the individual printheads. Each printhead assembly 30 prints one color such that a first color of an image is printed; a second color of the image is overprinted on the first color, and so on. In other embodiments, each printhead assembly can print more than one color, wherein individual printheads in each printhead assembly print a single color.

Generally, the imaging units 12, 14 contain four printhead assemblies, two on each side of the imaging unit, wherein each printhead assembly includes a plurality of printheads. The printhead assemblies 30 are positioned to guarantee that the direction of travel of a drop of ink from each printhead is substantially perpendicular to the surface of the associated drum 34 (and hence the paper web 18).

In the embodiment of FIGS. 2A and 2B, each printhead assembly 30 has the ability to print an image that is up to 12 inches (30.48 cm) wide. Further, two printhead assemblies 30 are axially positioned relative to one another so that the print width spans the width of the paper web 18 (typically 24 inches or 60.96 cm). This permits a printing width of up to 24 inches (60.96 cm). In this way, the imaging unit 12, 14 can print 2-up 8½×11 inch (21.59×27.94 cm) pages in either landscape or portrait fashion. Other page heights or widths could be produced in N-up fashion, if desired.

The printing system in other embodiments includes a series of modular units that can be utilized as needed for the printing task to be undertaken. In other words, each imaging unit may include only two printhead assemblies (one on the left half of the imaging unit and another on the right half of the unit) and the same or different inks may be fed to each printhead assembly so that each assembly can print one side of a 12-inch (30.48 cm) page. As noted above, each imaging unit may further include two additional printhead assemblies. The additional assemblies are positioned to overprint the color(s) deposited by the first two printhead assemblies. In this configuration, each imaging unit can simultaneously print two simplex 12 inch (30.48 cm) pages in two different colors. Two such imaging units operating in series can produce two simplex 12 inch (30.48 cm) four-color pages and four imaging units can produce two duplex 12 inch (30.48 cm) four-color pages. In addition, as noted above, depending upon the number of imaging units that are used, one could alternatively produce 24-inch (60.96 cm) simplex or duplex pages in one to four colors.

Figure 3:
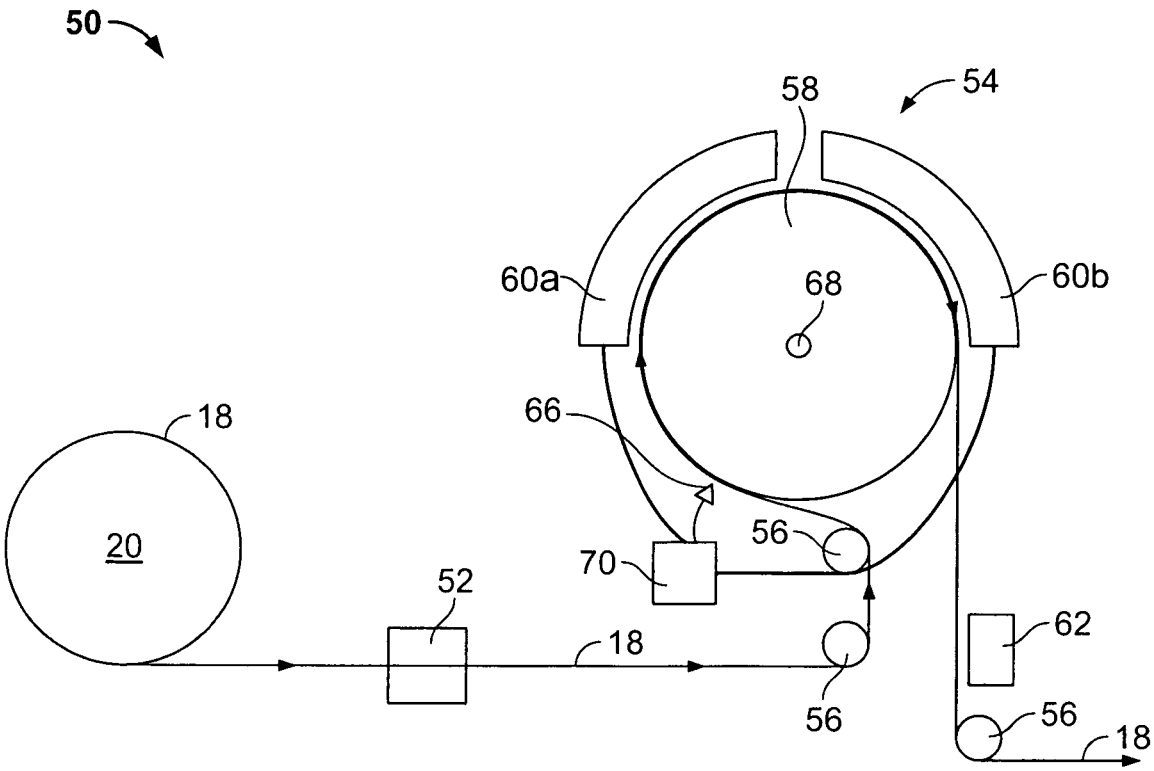
FIG. 3 is a diagrammatic side elevational view of a printing system according to another embodiment.

As seen in FIG. 3, a printing system 50 includes the paper web 18 arranged in the roll 20 that is driven through a sense mark printer 52 and then through an imaging unit 54 that prints images onto the paper web. Tension cylinders and turn-bars 56 are used to control the travel of the paper web 18 through the printing system 50. The paper web 18 contacts a drum 58 in the imaging unit 54 and the rotation of the drum drives the paper web past left and right printhead assemblies 60*a*, 60*b*, respectively. A frictional force between the drum 58 and the paper web 18 maintains a stable surface interface between the paper web and the drum as the paper web is being driven by the rotating drum. Generally, the frictional force will be sufficient so that the paper web does not slip while it is in contact with the drum. However, in other embodiments, the surface of the drum may be textured to increase the frictional force. In yet other embodiments, any appropriate system using tension cylinders, turn-bars, rotating drums, etc. can be used to deliver the paper web past the printheads.

In FIG. 3, the paper web 18 is in contact with the drum 58 along a majority of the circumference of the drum. This arrangement provides a stable non-slip surface interface between the paper web 18 and the drum 58 as the paper web is driven past the printheads in each printhead assembly 60*a*, 60*b*. Consequently, the position of the paper web 18 relative to each printhead can be calculated using the angular speed of the drum and the elapsed time. Also, the stable non-slip surface interface counteracts the tendency of the paper web to deform as ink is applied to the surface of the web. In one embodiment, the paper web 18 is in contact with the surface of the drum 58 along greater than 180 degrees. In another embodiment, the paper web 18 is in contact with the surface of the drum 58 along about 270 degrees. Consequently, the tension cylinders and turn-bars 56 can be arranged so that the paper web 18 first contacts the drum 58 near the bottom of the drum or along a substantially horizontal tangent line.

In FIG. 3, the paper web 18 is allowed to separate from the drum 58 at a position after the right printhead assembly 60*b*. The paper web separates from the drum along a substantially vertical tangent line and moves down into a drying station 62. The drying station 62 can include any appropriate type of drying device that removes moisture from the paper web 18 before the paper web is sent to downstream imaging units and/or finishing systems. For example, in some embodiments, a blower is used to pass air over the paper web or an infrared heater is used to dry the ink. As the paper web 18 separates from the drum 58, the ink on the paper web is still wet. In the embodiment of FIG. 3, the paper web 18 separates from the drum 58 and moves into the drying station 62 before the paper web contacts another tension cylinder or turn-bar 56. This arrangement allows the ink to dry while the paper web is in a substantially non-tensioned state. Consequently, the effects of paper deformation due to moisture from the ink can be minimized.

Figure 4:
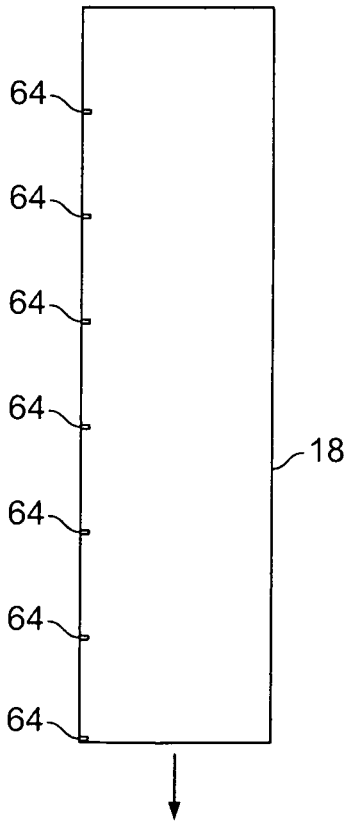
FIG. 4 is front plan view of a paper web that includes an embodiment of a sense mark.

The sense mark printer 52 is located upstream from the imaging unit 54 to print a sense mark 64 (FIG. 4) on the paper web at a position corresponding to the top of each printed page. FIG. 4 shows an embodiment of a sense mark 64 printed on a paper web 18, wherein the arrow indicates the forward direction in which the paper web moves through the print system. In FIG. 4, the sense mark 64 indicates a top of a form and is located along a side edge of the paper web 18. In other embodiments, the sense mark can indicate a bottom of a form or indicate some other portion of the form so long as the sense mark serves as a reference point for the printing of other images. Additionally, in other embodiments, the sense mark need not be printed along an edge of the paper web, but can be printed anywhere along the width of the web.

The sense mark printer 52 prints a plurality of sense marks 64 on the paper web 18, wherein consecutive sense marks are separated by a predetermined distance depending on the size of the finished page. Any type of ink may be used to print the sense mark; however, generally an ink is chosen that is both relatively inexpensive and easily detected by the sensor 66. In addition, the separate printer 52 uses an inexpensive printhead to print the sense mark 64 on the paper web 18. The embodiment of FIG. 3 gives greater latitude over printing systems that print a sense mark on a paper web using a dedicated first printhead, wherein a wider paper web is used to print a given finished product size, because the imaging units cannot print in the column where the sense mark is located. In contrast, using a separate printer that includes a relatively inexpensive printhead to print the sense mark on the paper web enables subsequent imaging units to print across the entire width of the paper web, including the column where the sense mark is located.

The sensor 66 associated with the imaging unit 54 detects the sense mark 64, and a sensor 68 associated with the drum 58 is used to track the speed and/or the position of the drum (and thus the paper web 18) as the drum rotates. In one embodiment, the sensor 68 associated with the drum 58 is a transducer located on the drum itself. In another embodiment, the sensor 66 that detects the sense mark 64 is a conventional optical sensor. For example, the optical sensor may include a light emitting diode ("LED"), a photodiode, and an amplifier, wherein the LED reflects light off of the substrate and the reflected light is detected by the photodiode to generate a sense signal when the light is reflected off of the sense mark. The sense signal is amplified and supplied to a control circuit 70, which controls the printheads in each printhead assembly 60*a*, 60*b* to print images onto the paper web 18.

In other embodiments, the sense mark printer 52 prints a plurality of sense marks 64 on the paper web using infrared inks that absorb infrared light or invisible inks that reflect ultraviolet light. In these embodiments, the sensor 66 will be adapted to detect the infrared or invisible inks.

The size of the sensor 66 and the size of the sense mark 64 can be adjusted so that the sensor can easily detect the sense mark. For example, the length and/or the width of the sense mark 64 can be matched to the dimensions of the sensor 66. In one embodiment, the sense mark 64 is about ⅛ of an inch (0.3175 cm) in the direction that the paper web 18 is traveling and ¼ to ⅜ of an inch (0.635-0.9525 cm) across the width of the paper web.

In FIG. 3, the sensor 66 is located at a position after the paper web 18 has contacted the drum 58. At this point, the surface contact between the paper web 18 and the surface of the drum 58 is stable and the effects of paper deformation are minimized. In addition, the relatively large contact area between the paper web 18 and the drum 58 further stabilizes the interface between the substrate and the drum so that the rotating drum drives the paper web without slipping. The sensor 66 detects the sense mark 64 at a point after which the paper web 18 has contacted the drum 58 to accurately control the printheads in each printhead assembly 60*a*, 60*b*.

The controller 70 associated with each printhead assembly 60*a*, 60*b* controls the printheads thereof so that the color components of the images are printed substantially in synchronism with the sense marks 64 and the registration or alignment of the color components of the images is accurately controlled. That is, the controller 70 receives a signal from the sensor 66 that the sense mark 64 has been detected and uses the speed and/or position of the drum 58, and hence the speed and/or position of the paper web 18, to control the respective printheads to print a raster line at a particular position of the paper web. The controller 68 then distributes segments of a raster line among the printheads in accordance with the position of each inkjet printhead. Each printhead has local circuitry (not shown) to translate the digital raster line data into analog signals that generate drops of ink deposited onto the paper web 18.

In another embodiment, the controller 70 electronically compensates for inherent delays in the sensor 66 and other electrical components. The controller 70 builds in an electronic delay before sending instructions to the printheads to print raster lines on the paper web 18. The electronic delay will vary depending on the speed of the paper web 18. For example, at full speed a shorter delay may be built in than at a slower speed. Consequently, the controller 70 instructs the printheads to begin printing on the paper web 18 at consistent distances from the sense mark 64.

The controller 70 stores and tracks the positions of a plurality of consecutive sense marks 64 to control the printing of each page moving past the printhead assemblies 60*a*, 60*b*. In one example, consecutive sense marks are separated by a short distance and the finished page size is small so that multiple pages are being printed by a single printhead assembly at the same time. The paper web 18 contacts the drum and the sensor 66 detects a first sense mark 64. The sensor 66 sends a detect signal to the controller 70, which stores the timing of the detect signal and tracks the position of the sense mark. At the appropriate time, the controller 70 instructs the printheads of the left printhead assembly 60*a* to begin printing the first page. While the first page is being printed, the drum 58 continues to rotate and the sensor 66 detects and the controller 70 tracks a second sense mark 64. The controller 70 instructs the printheads to begin printing the second page as the first page is being printed by the same left printhead assembly 60*a*. The drum 66 continues to drive the paper web 18 and consecutive sense marks are detected and tracked to control the printing of each page. After the left printhead assembly 60*a* has printed an image on the first page, the controller 70 continues to track the position of the first sense mark so that the right printhead assembly 60*b* can be controlled to print an image that is aligned with the image printed by the first printhead assembly. Likewise, the positions of consecutive sense marks are tracked to control the alignment of images printed by the left and right printhead assemblies 60*a*, 60*b*. Consequently, printed images can be aligned with the sense marks and with other images.

Figure 5:
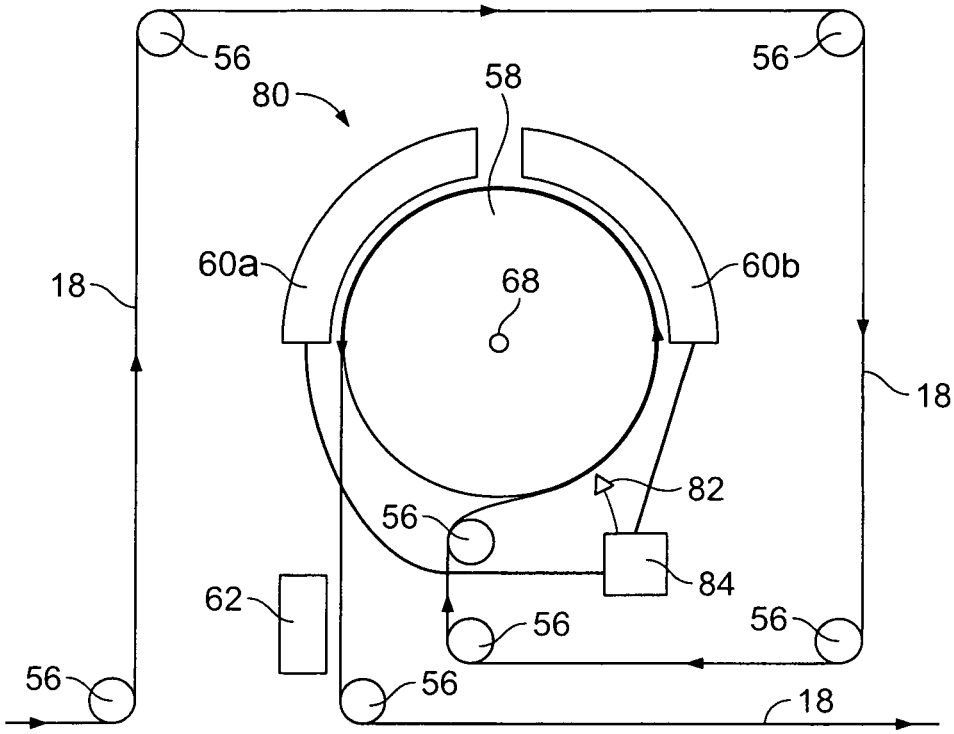
FIG. 5 is a diagrammatic side elevational view of a duplex printing system according to yet another embodiment.

Referring to FIG. 5, in yet another embodiment, the printing system 50 of FIG. 3 is adapted to print in duplex by adding a second imaging unit 80 downstream of a first imaging unit (not shown) that prints on a back side of the paper web after the first imaging unit prints on a front side of the paper web. The first imaging unit operates similarly to the embodiment of FIG. 3 and the second imaging unit 80 is substantially similar to the imaging unit 54 in FIG. 3. In FIG. 5, the paperpath of an imaging unit 80 is illustrated, wherein the paperpath is controlled by a number of tension cylinders or turn-bars 56 that feed the paper web 18 to the imaging unit 80 so that the back side of the paper web is printed. In particular, the paper web 18 is fed onto the drum 58, which is rotating in an opposite direction than the drum in FIG. 3, so that the paper web first moves past the right printhead assembly 60*b* and then past the left printhead assembly 60*a*. Alternatively, the first and second imaging units 54, 80 may be identical, wherein the second imaging unit is merely rotated 180 degrees so that the drums 58 of both imaging units are rotating in the same relative direction, i.e., clockwise, and the paper web moves past the left printhead assembly 60*a* first and then past the right printhead assembly 60*b*. As shown in FIG. 5, the paper web 18 contacts the drum near the bottom of the drum, i.e., along a substantially horizontal tangent line. In addition, the paper web 18 is allowed to separate from the drum 58 and moves down into a drying station 62 similarly to FIG. 3.

In the duplex printing system of FIG. 5, the separate printer 52 upstream from the imaging units 54, 80 prints a sense mark 64 on the front and back sides of the paper web 18. The sense mark 64 on the front side is used to control the respective printheads of the first imaging unit 54 in a manner similar or identical to that described above. The addition of the sense mark 64 on the back side of the paper web 18 is used to control the respective printheads of the second imaging unit 80 to print on the back side of the paper web. Referring to FIG. 5, a sensor 82 associated with the imaging unit 80 is located to detect the sense mark 64 at a position after which the paper web 18 has contacted the drum 58. The sensor 82 is connected to a controller 84 associated with each printhead assembly 60*a*, 60*b*, wherein the controller instructs the printheads in each printhead assembly to print images on the paper web 18 in accordance with the detection of the sense mark 64 and the position of the paper web. The sense mark 64 printed on the back side of the paper web 18 is aligned with the sense mark printed on the front side so that the images printed on the front and back sides are likewise aligned.

Figure 6:
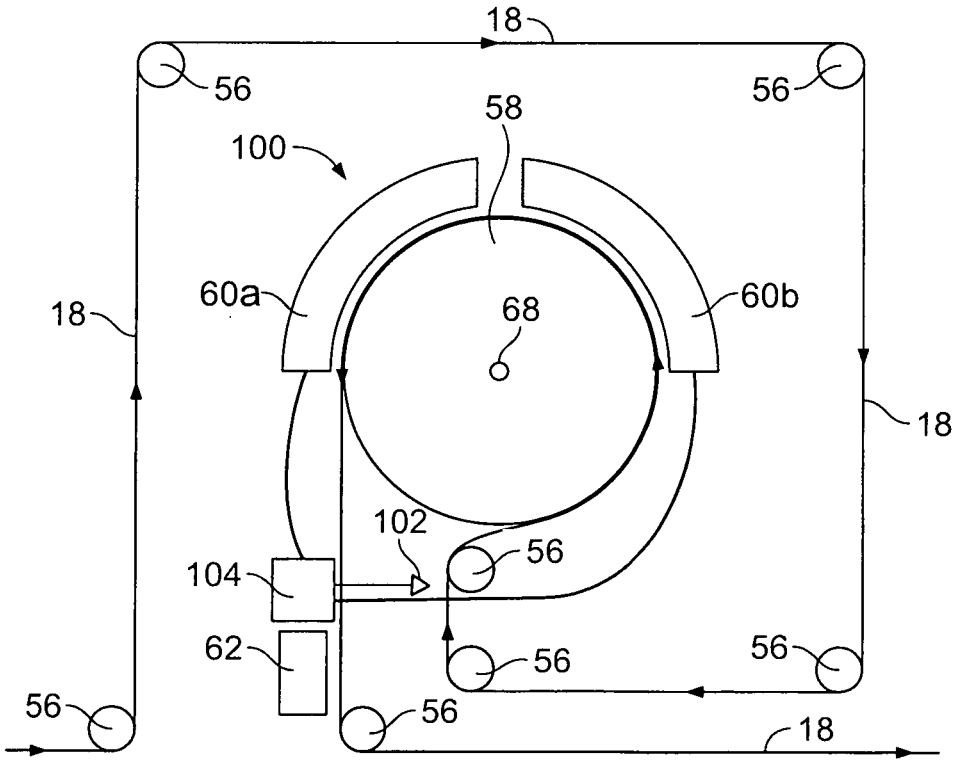
FIG. 6 is a diagrammatic side elevational view of a duplex printing system according to a further embodiment.

FIG. 6 shows an embodiment of a duplex printing system similar to FIG. 5, wherein the first printer 52 prints a sense mark only on the front side of the paper web 18. In this embodiment, the first imaging unit 54 includes a sensor 66 that detects the sense mark 64 and controls the respective printhead assemblies 60*a*, 60*b* as described previously. Referring to FIG. 6, a second imaging unit 100 includes a sensor 102 that is located to detect the sense mark 64 at a position immediately before the paper web 18 contacts the drum 58. Consequently, the sensor 102 is used to detect the sense mark 64 on the front side of the paper web 18. The detection of the sense mark 64 by the sensor 102 is communicated to a controller 104 that tracks the positions of multiple sense marks and instructs the respective printheads on each printhead assembly 60*a*, 60*b* to print images on the back side of the paper web 18. The large contact area between the paper web 18 and the drum 58 ensures a stable surface interface and an accurate determination of the position of the sense mark 64 and the paper web with respect to the printheads. The controller 104 accounts for the position at which the sensor is located so that the printheads can be accurately controlled.

A further embodiment of a duplex printing system is similar to the previously described embodiments and includes the sense mark printer 52 upstream from first and second imaging units, wherein the sense mark printer only prints a sense mark on the front side of the paper web 18. The first imaging unit detects the sense mark as described above. The second imaging unit is similar to FIG. 5 and includes a sensor that detects the sense mark on the paper web 18 at a position after which the paper web has contacted the drum 58. However, in this embodiment, a sensor used in the second imaging unit is capable of detecting the sense mark on the front side of the paper web through the paper web. For example, a sensitive photomultiplier type light detector may be used in the sensor to detect the sense mark through the paper web. Consequently, a single sense mark can be used to control printheads in a duplex printing system, wherein a relatively inexpensive optical sensor can be used in the first imaging unit and a more sensitive optical sensor can be used in the second imaging unit. Alternatively, the sense mark is printed only on one side of the paper web using infrared or invisible inks, wherein appropriate sensors can detect the marks through the paper web.

The previously described embodiments have included a separate printer to print a sense mark on a paper web and a sensor that detects the mark, wherein the detection of the mark is used to control printheads that print images on the paper web. It will be apparent to one of skill in the art upon reading this document that other systems and methods of using a sense mark to control printing on a substrate are contemplated and fall within the scope of the disclosure.

Figure 7:
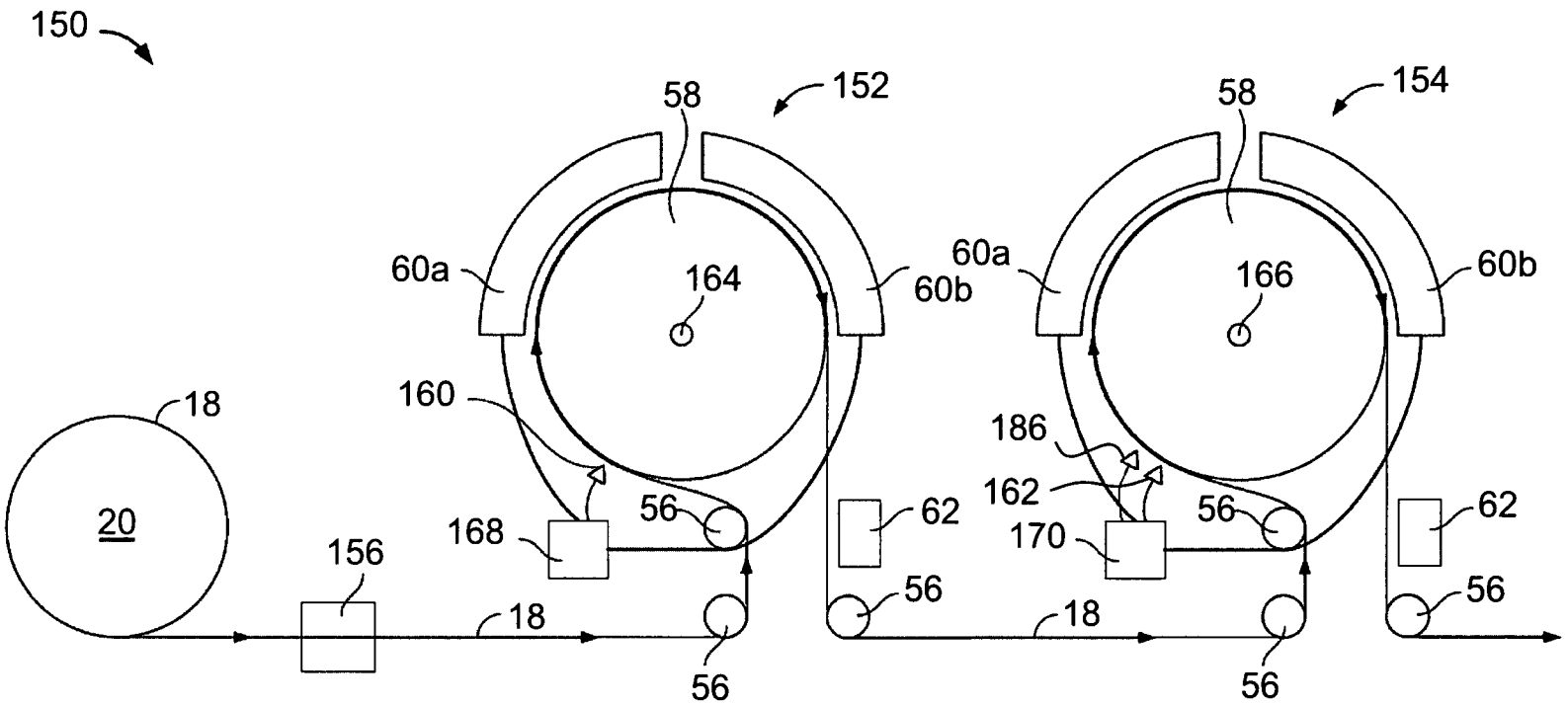
FIG. 7 is a diagrammatic side elevational view of a further embodiment of a printing system that includes first and second imaging units.

FIG. 7 illustrates another printing or imaging system 150 similar to the printing system 50 of FIG. 3 that includes first and second imaging units 152, 154, respectively. The imaging units 152, 154 are similar to the imaging unit 54 of FIG. 3 and are arranged to print simplex four color pages on a substrate. In FIG. 7, the substrate is a paper web 18 that is arranged in a roll 20 and driven through a paperpath defined, in part, by a plurality of tension cylinders or turn-bars 56 and a drum 58 of each imaging unit 152, 154. Further, each imaging unit 152, 154 includes left and right printhead assemblies or arrays 60*a*, 60*b*, respectively, that each print a single color on the paper web 18. For example, the left and right printhead arrays 60*a*, 60*b* of the first imaging unit 152 print in cyan and magenta, respectively, and the left and right printhead arrays 60*a*, 60*b* of the second imaging unit 154 print in yellow and black, respectively. The different colors printed by each printhead array 60 of the first and second imaging units 152, 154 can be overlaid over one another to thereby allow the printing system 150 to print full color images on the paper web 18. Further, in other embodiments, the arrangement or order of colors used by the printhead arrays 60 can be altered and/or different or additional colors can be used.

The imaging system 150 also includes a sense mark printer 156 that prints a sense mark 158 (shown in FIG. 8) on the paper web 18 that is similar to the sense mark 64 of FIG. 4. In addition, each imaging unit 152, 154 includes a sensor 160, 162, respectively, that is adapted to detect the sense mark 158 at a point where the paper web 18 is in contact with the drum 58 of each imaging unit 152, 154. At this point, the position of the sense mark 158 relative to the surface of the drum 58 is constant as the paper web 18 moves past the left and right printhead arrays 60*a*, 60*b*. This configuration of the sensors 160, 162 allows the imaging system 150 to use a single sensor associated with each imaging unit 152, 154, respectively, to detect the sense mark 158 at a single location and to use the detection of the sense mark to control the registration of both left and right printhead arrays 60*a*, 60*b*. The imaging units 152, 154 also include a sensor 164, 166, respectively, that are adapted to track the speed and/or position of the drum 58 (and thus the paper web 18). Further, each imaging unit 152, 154 includes a control circuit or controller 168, 170, respectively. The controllers 168, 170 process data from the sensors 162-166 and instruct the printhead arrays 60 of each imaging unit 152, 154, respectively, to print images that are in registration with each other along the length of the paper web 18, as described above.

Figure 8:
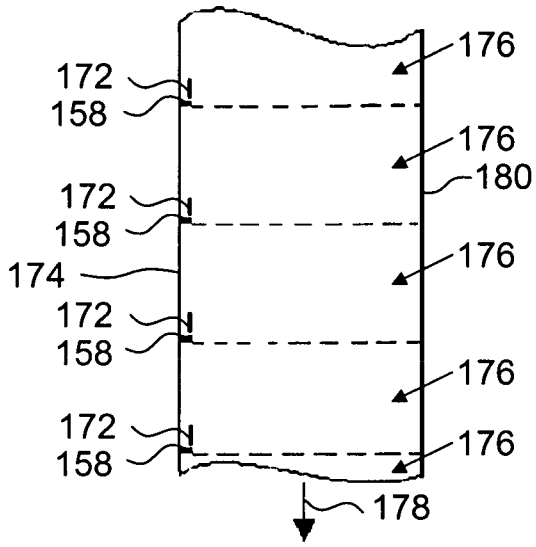
FIG. 8 is a front plan view of another embodiment of a paper web that includes a sense mark and registration indicia.

In the present embodiment, the controller 168 instructs the left printhead array 60*a* of the first imaging unit 152 to print alignment or registration indicia on the paper web 18. Referring to FIG. 8, the indicia are registration marks 172 printed along a right side margin 174 of the paper web 18 proximate to each sense mark 158, which indicate a top of a page or form 176. An arrow represents a direction of travel 178 of the paper web 18 through the printing system 150 and the right side margin 174 and a left side margin 180 are defined with respect to the direction of travel 178. In the present embodiment, the registrations marks 172 are lines that extend about ¼ of an inch to about 1 inch along a length of the paper web 18 in the direction of travel 178 and about ⅛ to about ½ of an inch along a width of the paper web 18 perpendicular to the length.

In other embodiments, the registration marks 172 can be printed along the left side margin 180 or at any point between the right and left side margins 174, 180, respectively, of the paper web 18.

Figure 9:
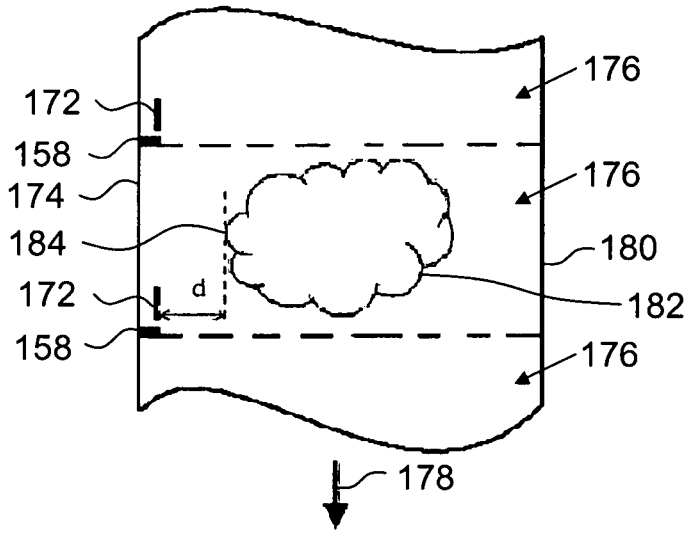
FIG. 9 is an enlarged view of the paper web of FIG. 8.

As discussed above, the sense marks 158 are printed before the first and second imaging units 152, 154 print images on the paper web 18 and the sense marks 158 are used to register images printed by the first and second imaging units 152, 154 along the length of the paper web 18 in the direction of travel 178. In the present embodiment, the registration marks 172 are used to register images printed by the printhead arrays 60 of the first and second imaging units 152, 154 along a lateral direction, e.g., along the width of the paper web 18. Referring to FIG. 9, during a printing process the paper web 18 is delivered to the first printing unit 152 and the left printhead array 60*a* receives instructions from the controller 168 to print the registration mark 172 and an image 182 for each form 176 on the paper web 18. The position of the registration marks 172 relative to the first imaging unit 152 is recorded or otherwise stored by the controller 168. In addition, the position of the image 182 relative to each registration mark 172 is also recorded or otherwise stored by the controller 168. In the present embodiment, a lateral distance (d) (shown in FIG. 9) between the registration mark 172 and a right edge 184 of the image 182 is stored by the controller 168. However, in other embodiments a mid-point or other reference point of the image 182 can be used as the reference point instead of the right edge 184 of the image. The position of the registration mark 172 relative to the first imaging unit 152 and the position of the image 182 relative to the registration mark 172 is used by the controller 168 to provide instructions to the right printhead array 60*b* of the first imaging unit 152 to print a next color component of the image 182 for each form 176 in lateral registration with the image 182 printed by the left printhead array 60*a*. After the right printhead array 60*b* prints the next color component of the image 182 on the paper web 18, the paper web separates from the drum 58 and moves into a drying station 62 as described above, and thereafter, the paper web is delivered to the second imaging unit 154 by a series of turn bars 56.

When the paper web 18 separates from the drum 58 of the first imaging unit 152, the stable surface interface between the paper web and the drum no longer prevents or counteracts the deformation of the paper web due to the moisture from the ink applied thereto. In addition, during the delivery of the paper web 18 to the second imaging unit 154, the lateral position of the paper web may shift or drift. Consequently, the position of the paper web 18 relative to the printhead arrays 60 of the second imaging unit 154 may be different than the position of the paper web 18 relative to the printhead arrays 60 of the first imaging unit 152 when the first imaging unit was printing images 182 on the paper web. Such differences must be corrected to ensure that the images 182 printed by the second imaging unit 154 are in registration with the images printed by the first imaging unit 152.

The printing system 150 of the present embodiment utilizes the registration marks 172 to correct for deformation and lateral shifts of the paper web 18 at the second imaging unit 154. Specifically, the paper web 18 is delivered to the second imaging unit 154 and driven past the printhead arrays 60 by the rotation of the drum 58. The second imaging unit 154 includes a registration mark sensor 186 that is configured to detect the registration marks 172 at a point where the paper web 18 is in contact with the drum 58. This configuration of the registration mark sensor 186 provides a reliable position detection of the registration marks 172, because the paper web 18 is in a fixed position relative to the surface of the drum 58, and hence the printhead arrays 60, as the paper web is in contact with the drum. In addition, the registration mark sensor 186 is positioned along an axis of rotation of the drum 58 at an expected position of the registration marks 172, e.g., at a position of the printhead that printed the registration mark. In one embodiment, the registration mark sensor 186 is a camera such as a CCD or CMOS image sensor. In yet another embodiment, the second imaging unit 154 includes a single sensor, such as the sensor 162 that is adapted to detect both the sense mark 158 and the position of the registration mark 172.

As the paper web 18 is driven past the printhead arrays 60 of the second imaging unit 154 by the drum 58, the registration mark sensor 186 detects the position of each registration mark 172 relative to the second imaging unit 154 and sends such positional data to the controller 170. The controller 170 compares the positional data from the second imaging unit 154 with a reference or expected position of the registration mark 172 and detects any differences in the relative positions of the registration mark 172. The expected position of the registration mark 172 corresponds to the positional data from the first imaging unit 152. Any difference between the detected position of the registration mark 172 and the expected position of the registration mark represent a shift in the paper web 18 with respect to the left and right printhead arrays 60*a*, 60*b* of the second imaging unit 154. The controller 170 corrects for any difference by instructing the printhead arrays 60 of the second imaging unit 154 to shift the image 182 accordingly. For example, if a registration mark 172 has shifted two pixels to the left, then the controller 170 instructs the left and right printhead arrays 60*a*, 60*b* to print the image 182 shifted two pixels to the left. Any other known algorithms may be used to correct for deformation and shifts once such problems are identified.

In another embodiment, the sense mark 158 printed by the sense mark printer 156 is used to correct for deformation and lateral shifts of the paper web 18. In this embodiment, the sense mark 158 is adapted to function as the registration mark 172, which is omitted. For example, the sense mark 158 can be a rectangular mark so that appropriate sensors associated with the first and second imaging units can detect the position of the sense mark in the direction of travel 178 and in a direction orthogonal to the direction of travel. Alternatively, the sense mark printer 156 prints both the sense mark 158 and the registration mark 172. In these two embodiments, the sensor 160 of the first imaging unit 152 is adapted to detect the position of the registration mark 172 and the controller 168 stores the position of the registration mark with respect to the first imaging unit 152 and instructs the left and right printhead arrays 60*a*, 60*b* to print images in registration. Alternatively, the first imaging unit includes a registration mark sensor similar to the registration mark sensor 186 in addition to the sensor 162. The second imaging unit 152 operates as describe above.

In yet another embodiment, the registration mark 172 is omitted and appropriate sensors associated with the first and second imaging units track a side edge, such as the right or left side margin 174, 180. The controllers 168, 170 track the position of the side edge to correct for deformation and lateral shifts of the paper web 18.

Further, it would be apparent to one skilled in the art to apply the discussion of FIGS. 7-9 to expand the duplex printing systems of FIGS. 1, 5, and 6 to print duplex four-color pages in registration using four imaging units.

Figure 10:
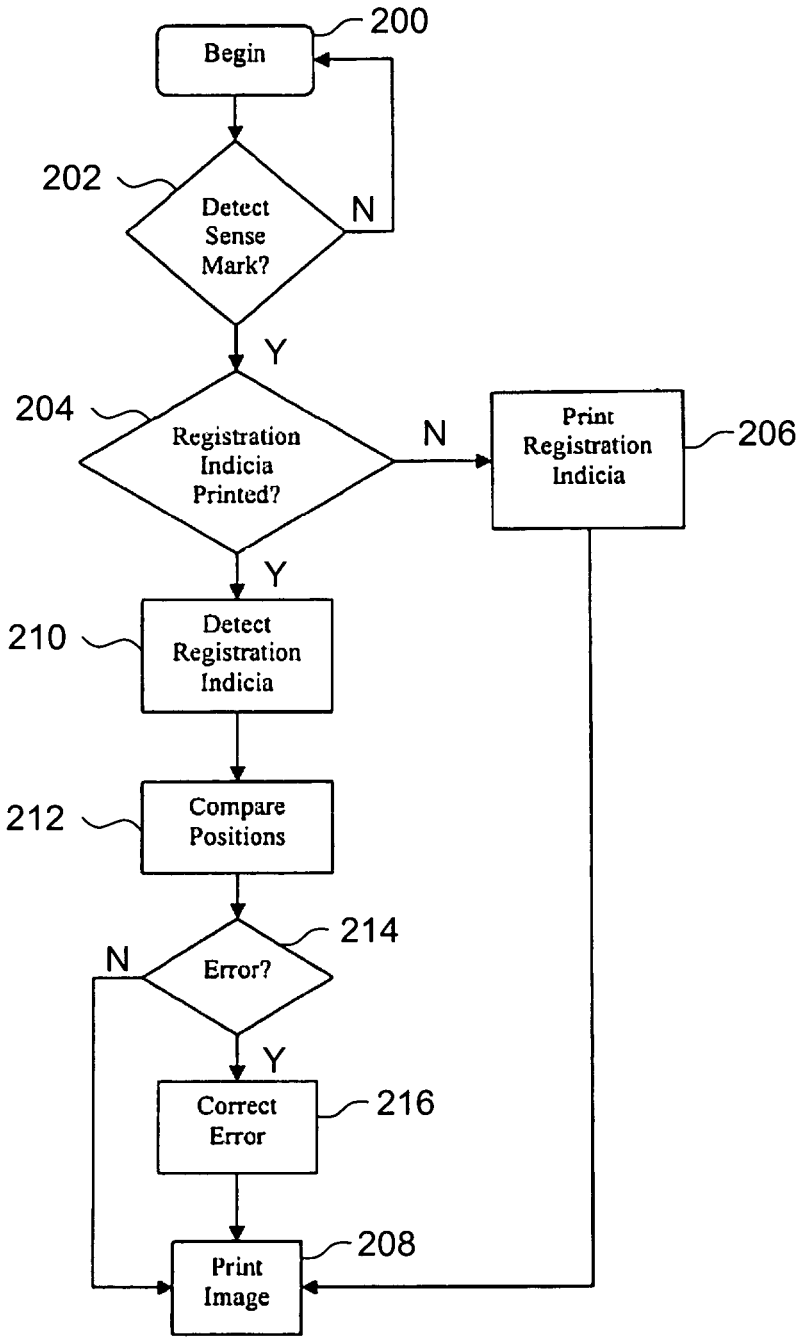
FIG. 10 is a flowchart according to another embodiment of a printing process.

FIG. 10 shows an embodiment of the general steps performed to control the imaging units 152, 154 to print color images on a paper web 18 in registration along the length and width of the paper web. The process begins at a block 200 and proceeds to a decision block 202 that determines if a sense mark, such as the sense mark 158, is detected. Control passes back to the "begin" block 200 if a sense mark 158 is not detected. If a sense mark 158 is detected, control passes to a decision block 204 that determines if registration indicia, such as the registration marks 172, have been printed. If the registration marks 172 have not been printed, e.g., at the first imaging unit 152, then control passes to a block 206 that instructs the imaging unit to print the registration marks 172. During the block 206, a position of the registration marks 172 relative to the imaging unit 152, 154 is also recorded or stored.

Following the block 206, control passes to a block 208 that instructs the printhead arrays 60 to print the images 182 on the paper web 18 in accordance with the detection of the sense mark 158 at the block 202 so that the images printed by the first and second imaging units 152, 154 are in registration along the length of the paper web. In addition, during the block 208 the printhead arrays 60 are instructed to print the images 182 at a position relative to the registration marks 172 so that the images are in registration along the width of the paper web 18, wherein the position of the images relative to the registration marks is stored.

If the registration marks 172 have been printed, then control passes to a block 210 that detects the position of the registration marks. Thereafter, control passes to a block 212 that compares the detected position of the registration marks with a reference or expected position of registration marks, wherein the reference or expected position is a previously stored position, e.g., the position stored during the block 206. At a decision block 214, a difference between the detected position and the reference position indicates an error to be corrected. If no error is detected, then control passes to the block 208 and the image 182 is printed by the printhead arrays 60. Otherwise at a block 216, an error is corrected by shifting a color component of an image 182 laterally in accordance with the difference between the detected position and the reference position. Any such correction is communicated to the block 208, which adjusts the position of the image 182 relative to the registration indicia 172 before instructing the printhead arrays 60 to print the images. In other embodiments, different algorithms can be used to correct for errors detected at the block 214.

INDUSTRIAL APPLICABILITY

The present disclosure is applicable in the printing arts, for example, to register image data printed by one or more imaging units. More particularly, the use of a registration indicium is used to register image data on a substrate in a lateral direction.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A method of printing on a substrate, comprising the steps of:

instructing a first imaging unit to print a first image and a single registration mark associated with the first image on a substrate contemporaneously during a production run;

detecting the registration mark at a point where the registration mark is within a second imaging unit;

calculating an offset along a width direction of the substrate based on the detected single registration mark;

determining a position on the substrate where a second image is to be printed in accordance with the calculated offset, wherein the second image is shifted in its entirety and printed on the same side of the substrate as the first image; and instructing the second imaging unit to print the second image on the substrate in accordance with the determined position.

2. The method of claim 1, wherein the step of detecting detects a position of the registration mark relative to the second imaging unit and the step of determining compares the detected position of the registration mark with an expected position of the registration mark relative to the second imaging unit to establish the offset of the registration mark, and wherein the offset is used to determine the position where the second image is to be printed.

3. The method of claim 2, further comprising the steps of developing position data that corresponds to the first imaging unit and determining the expected position of the registration mark with the position data.

4. The method of claim 3, wherein the position data includes a position of the registration mark relative to the first imaging unit and a position of the first image relative to the registration mark.

5. The method of claim 1, wherein a first controller controls the first imaging unit and a separate second controller controls the second imaging unit, wherein the second controller undertakes the step of determining the position.

6. The method of claim 1, further comprising the steps of detecting a sense mark on the substrate at the first imaging unit and instructing the first imaging unit to print the first image and the registration mark in accordance with the detection of the sense mark and detecting the sense mark at the second imaging unit and instructing the second imaging unit to print the second image in accordance with the detection of the sense mark and the determined position.

7. The method of claim 1, further comprising the steps of feeding the substrate onto a first drum associated with the first imaging unit, wherein the first image and the registration mark are printed on the substrate at a position where the substrate is in contact with the first drum and feeding the substrate onto a second drum associated with the second imaging unit, wherein the second image is printed on the substrate at a position where the substrate is in contact with the second drum.

8. The method of claim 1, wherein the registration mark is detected at a location where the substrate is in contact with a drum.

* * * * *